US009656822B2

(12) United States Patent
Matsushita et al.

(10) Patent No.: US 9,656,822 B2
(45) Date of Patent: May 23, 2017

(54) SUPPORT DEVICE AND DATE MANAGEMENT METHOD

(71) Applicant: LINTEC CORPORATION, Tokyo (JP)

(72) Inventors: Kaori Matsushita, Tokyo (JP); Kazuhisa Yamaguchi, Tokyo (JP); Kenichi Watanabe, Tokyo (JP); Naoya Okamoto, Tokyo (JP)

(73) Assignee: LINTEC CORPORATION, Tokyo (JP)

( * ) Notice: Subject to any disclaimer, the term of this patent is extended or adjusted under 35 U.S.C. 154(b) by 48 days.

(21) Appl. No.: 14/760,775

(22) PCT Filed: Jun. 5, 2013

(86) PCT No.: PCT/JP2013/003526
§ 371 (c)(1),
(2) Date: Jul. 14, 2015

(87) PCT Pub. No.: WO2014/125524
PCT Pub. Date: Aug. 21, 2014

(65) Prior Publication Data

US 2015/0360895 A1 Dec. 17, 2015

(30) Foreign Application Priority Data

Feb. 13, 2013 (JP) ..... 2013-025884

(51) Int. Cl.
*B65H 16/04* (2006.01)
*B65H 75/24* (2006.01)
(Continued)

(52) U.S. Cl.
CPC ..... *B65H 16/04* (2013.01); *B65H 18/026* (2013.01); *B65H 18/103* (2013.01);
(Continued)

(58) Field of Classification Search
CPC .... B65H 16/04; B65H 18/026; B65H 18/103; B65H 75/242
See application file for complete search history.

(56) References Cited

U.S. PATENT DOCUMENTS 4,991,785 A * 2/1991 Kuo ..... B65H 75/242 242/575.3
5,011,094 A * 4/1991 Azuma ..... B65H 16/04 242/573.1
(Continued)

FOREIGN PATENT DOCUMENTS

JP 2-55650 U 4/1990
JP 2007-012807 A 1/2007

OTHER PUBLICATIONS

Office Action from Japanese Patent App. No. 2013-025884 (Aug. 23, 2016).
(Continued)

*Primary Examiner* — Sang Kim
(74) *Attorney, Agent, or Firm* — Cermak Nakajima & McGowan LLP; Tomoko Nakajima

(57) ABSTRACT

A support device for supporting a cylindrical member around which is wound an elongated body has: a support shaft for supporting the cylindrical member that is fitted to an external surface of the support shaft from an opening on one end in a longitudinal direction of the cylindrical member; an anchoring plates, built into the support shaft, for anchoring the cylindrical member from an inner circumferential side of the cylindrical member; and an operating means having an operation shaft of a smaller diameter than the support shaft, the operation shaft protruding forward from a distal end of the support shaft in order to operate the anchoring plates. Further, the support device has a protecting member which is attached to the distal end of the support shaft and through which is inserted the operation shaft. The
(Continued)

protecting member further has a reduced-diameter section smaller in diameter than the support shaft.

2 Claims, 4 Drawing Sheets

(51) Int. Cl.
*B65H 18/10* (2006.01)
*B65H 18/02* (2006.01)

(52) U.S. Cl.
CPC ... *B65H 75/242* (2013.01); *B65H 2301/4132* (2013.01); *B65H 2301/51122* (2013.01); *B65H 2403/52* (2013.01); *B65H 2404/411* (2013.01); *B65H 2557/13* (2013.01); *B65H 2701/194* (2013.01)

(56) References Cited

U.S. PATENT DOCUMENTS

| | | | | |
|---|---|---|---|---|
| 6,059,222 | A * | 5/2000 | Yuyama | B65H 16/04 242/421.4 |
| 8,392,011 | B2 * | 3/2013 | Segawa | H01L 21/67294 156/496 |
| 2007/0125900 | A1 * | 6/2007 | Akahori | B65H 16/04 242/590 |
| 2007/0162175 | A1 | 7/2007 | Segawa et al. | |

OTHER PUBLICATIONS

International Search Report for PCT Patent App. No. PCT/JP2013/003526 (Jul. 2, 2013).

* cited by examiner

SUPPORT DEVICE AND DATE MANAGEMENT METHOD

This application is a national phase entry under 35 U.S.C. §371 of PCT Patent Application No. PCT/JP2013/003526, filed on Jun. 5, 2013, which claims priority under 35 U.S.C. §119 to Japanese Patent Application No. 2013-025884, filed Feb. 13, 2013, both of which are incorporated by reference.

TECHNICAL FIELD

The present invention relates to a support device for supporting a cylindrical member around which is wound an elongated body, and also relates to a data management method for managing data relating to an elongated body wound around the cylindrical member by using the support device.

BACKGROUND ART

For example, a sticking device is known, in which an elongated body (raw sheet) having temporarily adhered on one of the release sheet an adhesive sheet or labels is wound around a cylindrical body; then on an adhesive sheet or a label temporarily bonded to one surface of a release sheet is wound around a cylindrical member; the elongated body is continuously delivered to thereby adhere on the surfaces of the adherend such as semiconductor wafers, containers or the like. When such a sticking device is used depending on different kinds in accordance with a type of the elongated body, it is desired in terms of production management to manage data on processing such as a sheet-delivering speed, etc., according to a property of the elongated body, and also to manage various data on the type (trade name) of the elongated body wound around the cylindrical member, a lot number, date of manufacture, a used amount, a residual amount, a quality assurance period, and the like (hereinafter, simply referred to as "data").

In the known art, a support device for supporting the cylindrical member around which is wound the elongated body is known, for example, in Patent Literature 1. This support device comprises: a support shaft (winding shaft) supported by a support body in a cantilevered state; an anchoring shaft (delivery shaft) for supporting the cylindrical body that is externally inserted into the support shaft from an opening one end in a longitudinal direction of the cylindrical member; and a support shaft (rotation-resisting member) that is built inside the support shaft in a manner to be moveable out of (beyond) or into through holes formed in an outer surface of the cylindrical member but that anchors the cylindrical member from an inner circumferential side of the support shaft. A data carrier member for storing the above-described data is disposed on the inner circumferential surface of the cylindrical member, and data communication means (data reading in and reading out device) for performing data communication with the data carrier member is mounted on the support shaft.

An operating means is usually additionally provided with an anchoring means in order to operate the switching between the anchoring and the releasing of the cylindrical member. As an example of this kind of operating means, there is one having: an operating shaft (shaft part) which is smaller in diameter than the support shaft, and which are provided coaxially inside the support shaft and protrudes forward from a distal end of the support shaft where a side on which the support shaft is supported in the cantilevered state is defined as a proximal end and where an opposite side thereto is defined as a distal end; an operation shaft (shaft part) which is smaller in diameter than the support shaft; and a cam member which is externally inserted into the operation shaft. When an operating knob disposed at the distal end of the operation shaft is manually turned in one direction from a releasing position where the anchoring means is located in the support shaft, the anchoring means abutting on the cam member is pressed diametrically outward depending on the turning angle, protrudes from an outer diameter surface of the support shaft, and engages with an inner surface of the cylindrical member. The cylindrical member is thereby anchored or fixed on the inner circumferential side thereof (anchoring position).

By the way, as in the above-described known art, when the data communication means is built (or incorporated) in the support shaft, it is necessary to externally insert the cylindrical member into the support shaft while matching the positions of the data carrier member and the data communication unit. This may deteriorate workability. In addition, it is necessary to perform wiring for data communication or power supply through the support shaft which is a part to be rotated and driven and in which the above-described operating means is built. This needs to use, for example, a rotary joint or a slip ring. This may make a structure of the support shaft more complicated, and in addition, may cause increase in cost. Therefore, data communication is also performed by making, for example, a hand-held type data communication unit close to the data carrier member by a conveyance robot, a manual operation by a worker, or the like if necessary, while the data communication unit is not built in the support shaft.

Here, for example, when the data carrier member includes a label-shaped IC tag in which an IC chip and an antenna are held on one surface of a substrate sheet in order to store or transmit various data in a non-contact manner using an electromagnetic wave as a communication medium, the IC chip of the label-shaped IC tag may be easily broken even by a weak shock. Therefore, there can be considered the following structure, i.e., the size of the cylindrical member is determined such that a portion having a predetermined length on a rear side in the external insertion direction extends forward from the distal end of the support shaft when the cylindrical member is externally inserted into the support shaft, and the data carrier member is disposed on an inner circumferential surface of the portion not in contact with the support shaft, where data communication with the data communication unit is easily performed.

However, in an arrangement in which the size of the cylindrical member is determined such that the portion having the predetermined length on the rear side in the external insertion direction extends forward from the distal end of the support shaft, it is necessary to design the operation shaft of the operating means so as to have a length protruding from the rear end in the external insertion direction of the cylindrical member. With this design, the length of the operation shaft protruding from the distal end of the support shaft is also long. Here, when the elongated body is wound around the cylindrical member, a weight thereof may be a dozen or so kilograms, and the cylindrical member may be caught by the operation shaft when a worker externally inserts the cylindrical member into the support shaft. At this time, when the length of the operation shaft protruding from the other end of the support shaft is long, bending rigidity of the operation shaft is low, and the operation shaft may be bent by a load of the cylindrical member.

PRIOR ART DOCUMENTS

Patent Literature

Patent Literature 1: JP 2007-12807 A

SUMMARY OF INVENTION

Problems that the Invention is to Solve

In view of the above-described problems, an object of the present invention is to provide a support device and a data management method. In the support device, a data carrier member can be disposed on an inner circumferential surface of a cylindrical member such that the data carrier member is not broken by coming into contact with a support shaft, and a shaft part for operating an anchoring means has high bending rigidity. The data management method manages data on an elongated body wound around the cylindrical member by using the support device.

Means for Solving the Problems

In order to solve the above-mentioned problems, there is provided a support device for supporting a cylindrical member around which is wound an elongated body.

The support device comprises: a support shaft, supported by a support body in a cantilevered state, for supporting the cylindrical member that is fitted to an external surface of the support shaft from an opening on one end in a longitudinal direction of the cylindrical member; an anchoring means, built into the support shaft, for anchoring the cylindrical member from an inner circumferential side of the cylindrical member; an operating means comprising a shaft part smaller in diameter than the support shaft, the shaft part protruding forward from a distal end of the support shaft where a side on which the support shaft is supported in the cantilevered state is defined as a proximal end and where an opposite side thereto is defined as the distal end, the shaft part being arranged to switch between anchoring of the cylindrical member by the anchoring means and releasing thereof; and a protecting member which is attached to the distal end of the support shaft and through which is inserted the shaft part, the protecting member further comprising a reduced-diameter section smaller in diameter than the support shaft.

In addition, in order to solve the above-mentioned problems, there is provided a data management method for managing data relating to an elongated body wound around a cylindrical member by using the above-described support device. The method comprises: fitting the cylindrical member to an external surface of the support shaft from the opening on one end in the longitudinal direction of the cylindrical member; performing data communication between a data communication means and a data carrier member which is disposed in a carrier disposition area, where an inner circumferential surface of such a portion of the cylindrical member as is positioned in front of the proximal end of the reduced-diameter section is defined as the carrier disposition area.

Effects of Invention

According to the present invention, a protecting member is attached to the distal end of the support shaft, and a shaft part is inserted into the protecting member, thereby protecting the shaft part. Therefore, a protrusion length of the shaft part can be made shorter by the length of the protecting member. Therefore, bending rigidity of the shaft part can be made higher than that in the above-described prior art, and bending of the shaft part by a load of a cylindrical member can be suppressed. In addition, when a reduced-diameter section is formed in the protecting member, there will occur no such a problem that a data carrier member, that is disposed on an inner circumferential surface of such a portion of the cylindrical member as is positioned in front of the distal end of the reduced-diameter section, may be broken due to contact with the support shaft when the cylindrical member is fitted to an external surface of the support shaft.

EMBODIMENTS TO CARRY OUT INVENTION

Hereinafter, an embodiment will be described with reference to the drawings using, as an example, a case in which a support device of the present invention is applied to a delivering part of a sheet sticking device which adheres an adhesive sheet AS to an adherend AH. Here, the terms "left", "right", "upper", and "lower" to show the positions are based on FIG. 1 unless particularly indicated otherwise. A side where a support shaft, to be described later, is supported in a cantilevered state is referred to as a proximal end (front side or "this side" in FIG. 1), and a side opposite thereto is referred to as a distal end (back side in FIG. 1). The side of the distal end is referred to as "front" or "forward", and the side of the proximal end is referred to as "rear", if necessary.

Figure 1:
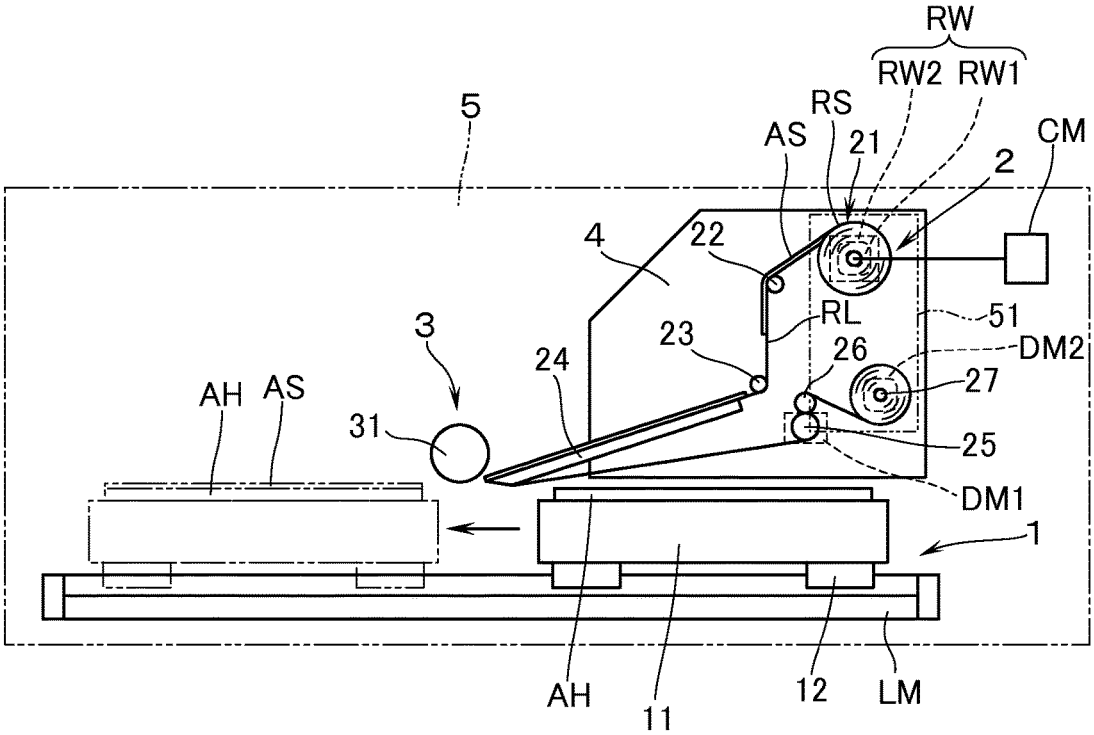
FIG. 1 illustrates a side view of a sheet sticking device including a support device according to an embodiment of the present invention.

With reference to FIG. 1, the sheet sticking or adhering device comprises: a conveying means 1 for conveying the adherend AH; a delivering means 2 for delivering a raw sheet RS as an elongated body, the delivering means 2 being disposed above the conveying means 1; a pressing means 3 for pressing the adhesive sheet AS to the adherend AH, the pressing means 3 being disposed on the left of the delivering means 2: a frame 4 for supporting the delivering means 2: and a cover 5 for covering the conveying means 1, the delivering means 2, and the pressing means 3.

The conveying means 1 comprises: a table 11 for sucking and holding the adherend AH at a position below the frame 4: and a linear motion motor LM which is disposed below the table 11 and which acts as a driving equipment capable of conveying the table 11 in the right and left directions through a slider 12.

The delivering means 2 comprises: a delivering part 21 which serves as a support device for supporting the raw sheet RS to which a multiplicity of adhesive sheets AS are temporarily bonded at intervals therebetween through an adhesive layer (not illustrated): two guide rollers 22, 23, one on an upper side and the other on a lower side; a release plate 24 for releasing the adhesive sheet AS off from the release sheet RL by folding back the release sheet RL; a driving roller 25 and a nip roller 26 for pinching a release sheet RL that has passed through the release plate 24; and a winding shaft 27 for winding the release sheet RL. The driving roller 25 and the winding shaft 27 are respectively driven for rotation by the rotation motors DM1, DM2 as respective driving devices.

Figure 2:
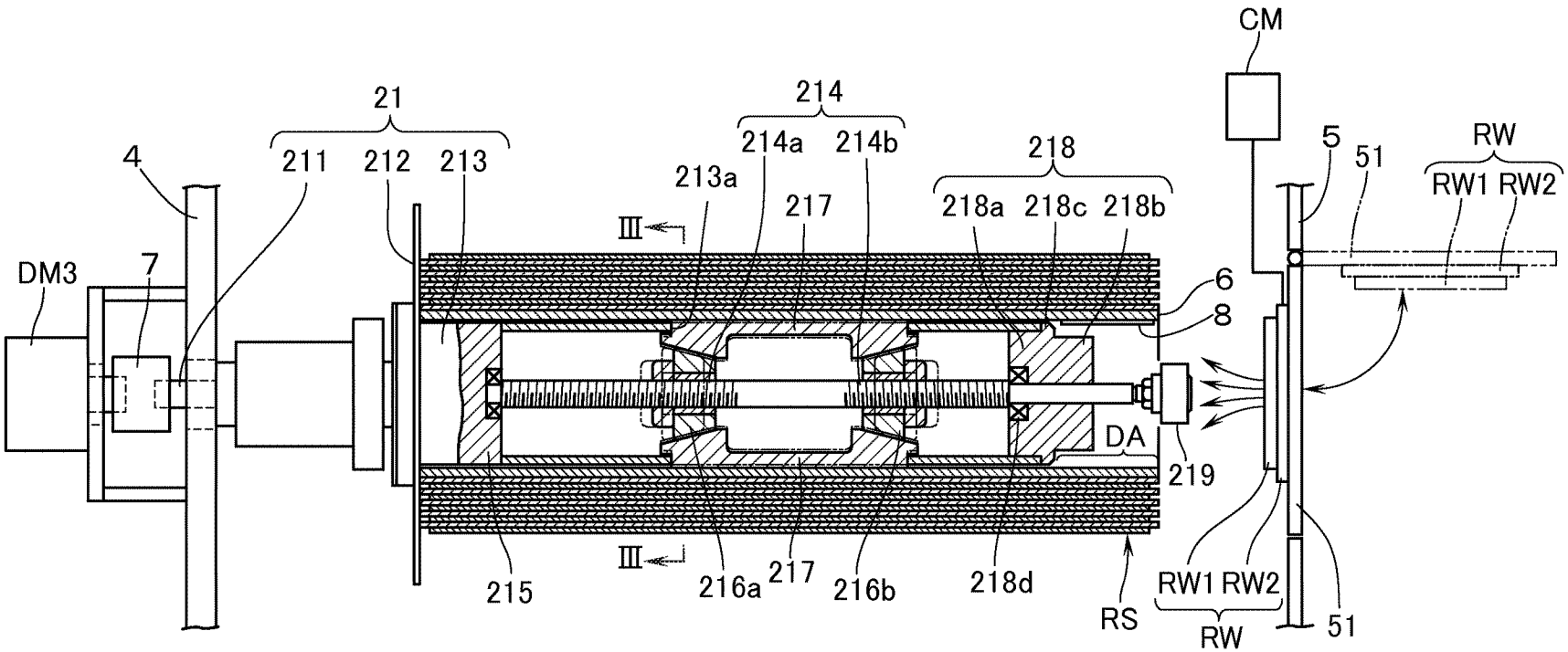
FIG. 2 is a plan view of the support device according to the embodiment.
Figure 3A:
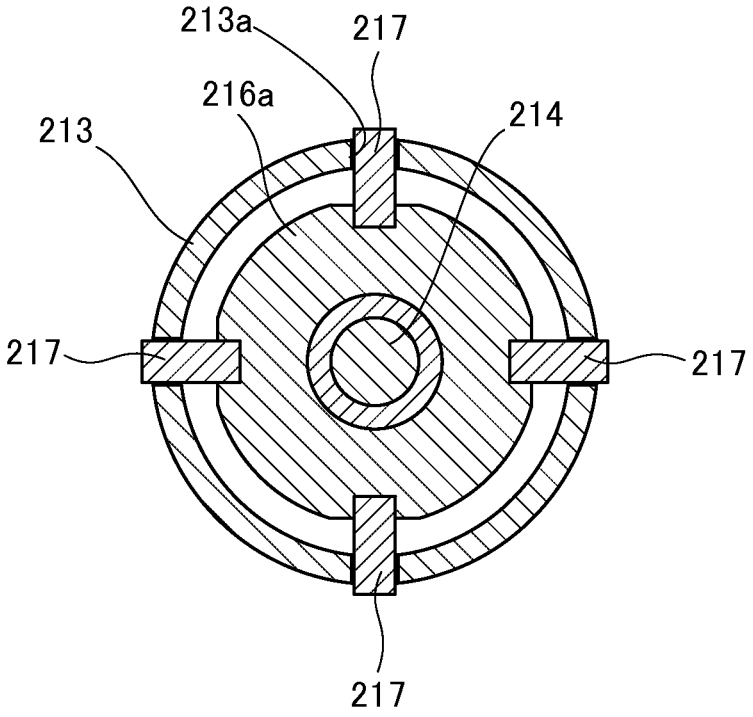
FIG. 3(*a*) is a cross sectional view of a support shaft along line III-III in FIG. 2 when an anchoring means is at an anchoring position, and FIG. 3(*b*) is a cross sectional view thereof when the anchoring means is at a releasing position.
Figure 3B:
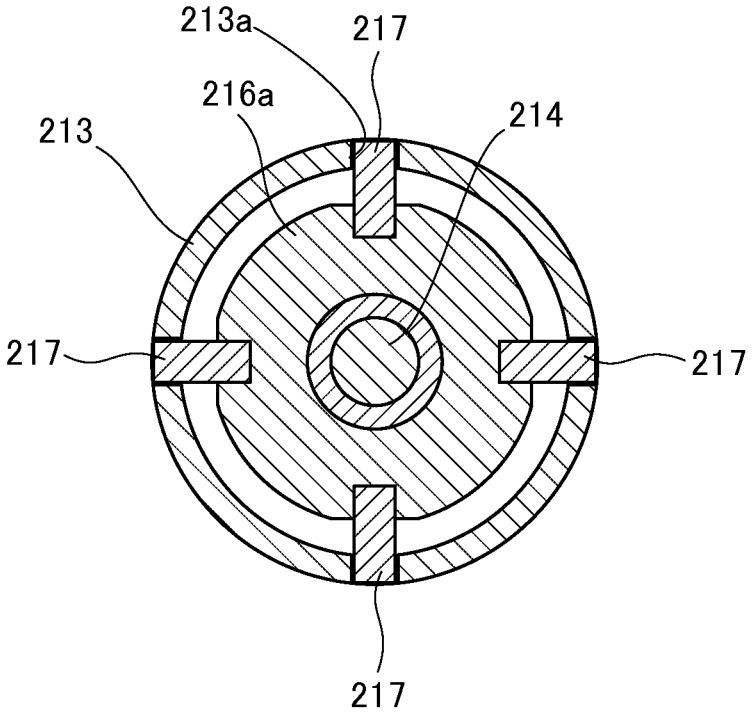

With reference further to FIGS. 2, 3(*a*), and 3(*b*), the delivering part 21 comprises: a basic shaft 211 which is disposed to penetrate through the frame 4 as a support body; and a support shaft 213 which is fitted on an external surface of the right end side of the basic shaft 211 in FIG. 2, and which is supported in a cantilevered state while a positioning part 212 is disposed on a side of the frame 4. A rotary drive motor DM3 as a driving equipment is connected to a left end side of the basic shaft 211 in FIG. 2 through a coupling 7. The support shaft 213 is formed of a metallic hollow round rod. At predetermined positions on an outer circumferential surface of the support shaft 213, slit-shaped through holes 213*a* are disposed at 90° intervals in a circumferential direction on the same circumference. The operation shaft 214 as a shaft part is incorporated in the support shaft 213 concentrically to the support shaft 213.

The operation shaft 214 has a smaller diameter than the support shaft 213. The operation shaft 214 includes feed screw parts 214*a*, 214*b* having opposite screwing directions to each other. The proximal end of the operation shaft 214 (left end in FIG. 2) is supported by a bearing 215 internally inserted into a side of the proximal end of the support shaft 213. The feed screw parts 214*a*, 214*b* of the operation shaft 214 are screwed with cam members 216*a*, 216*b* at predetermined intervals in the longitudinal direction, respectively. Four anchoring plates 217, 217 abut on both the cam members 216*a*, 216*b*. The four anchoring plates 217, 217 constitute a projectable and retractable anchoring means through each of the through-holes 213*a* of the support shaft 213. An operating knob 219 is disposed at the distal end of the operation shaft 214. In this case, the operation shaft 214, both of the cam members 216*a*, 216*b*, and the operating knob 219 constitute an operating means which operates projection and retraction of the anchoring plates 217, 217. In addition, a protecting member 218 is disposed at the distal end of the support shaft 213. The operation shaft 214 is inserted into the protecting member 218. The length of the operation shaft 214 is determined such that the operating knob 219 extends forward from a cylindrical member 6 when the cylindrical member 6 is fitted to an external surface of the support shaft 213 and positioned.

The protecting member 218 is made of a resin having a relatively high mechanical strength, such as fluororesin. The protecting member 218 comprises: a base part 218*a* which is on a side of the proximal end and is fitted to a distal end opening of the support shaft 213; and a reduced-diameter section 218*b* which is continuous in the forward direction from the base part 218*a* and has a smaller diameter than the support shaft 213. When a flange part 218*c* formed in the base part 218*a* abuts on the distal end opening of the support shaft 213, the protecting member 218 is arranged to be positioned. The protecting member 218 includes a built-in bearing 218*d* so that a side of the distal end of the operation shaft 214 is supported thereby. The both end-open type cylindrical member 6 around an outer circumference of which the raw sheet RS is wound is fitted to an external surface of the support shaft 213 from an opening (left side in FIG. 2) on one end in a longitudinal direction thereof. The raw sheet RS is thereby arranged to be supported by the delivering part 21. In this case, when the above-described one end of the cylindrical member 6 abuts on the positioning part 212, positioning is performed. If the protecting member 218 is made of a resin, as described later, when a data carrier member is constituted by an IC tag and a data communication means is constituted by a reader-writer for the IC tag, data communication between the IC tag and the reader-writer is not adversely affected, and can be performed smoothly. Examples of the resin for the protecting member 218 include polypropylene, an acrylonitrile-butadiene-styrene copolymer, an acrylonitrile-ethylene propylene rubber-styrene copolymer, polyamide, polycarbonate, polyacetal, polyethylene, polystyrene, polyarylate, polyphenylene oxide, polymethyl methacrylate, polyvinyl chloride, polysulfone, polyether sulphone, polyphenylene sulfide, polyarylate, polyamideimide, polyether imide, polyetherether ketone, polyimide, fluororesin, polyethylene terephthalate, polybutylene terephthalate, a styrene-butadiene-styrene block copolymer, a styrene-isoprene-styrene block copolymer, natural rubber, ethylene propylene rubber, ethylene propylene diene rubber, styrene butadiene rubber, butadiene rubber, butyl rubber, nitrile butadiene rubber, and chloroprene rubber. However, the resin for the protecting member 218 is not limited to these resins. The reduced-diameter section 218*b* is only required to have a diameter not in contact with the data carrier member. Therefore, the reduced-diameter section 218*b* has a diameter, preferably 5 mm or more, more preferably 10 mm or more, smaller than the support shaft 213. In order to protect the operation shaft 214, the reduced-diameter section preferably has a diameter which is larger than the support shaft 213 by a difference of 30 mm or more.

The size of the cylindrical member 6 is determined such that a portion having a predetermined length on a rear side in the external insertion direction extends from the distal end of the support shaft 213. The cylindrical member 6 is made of, for example, paper or a resin. An inner circumferential surface of such a part of the cylindrical member 6 as is located further forward than the distal end of the reduced-diameter section 218*b* constitutes a carrier disposition area DA. In the carrier disposition area DA, a data carrier member which can store and/or transmit predetermined data is disposed. The cylindrical member 6 is fitted to an external surface of the support shaft 213 and positioned. Thereafter, when the operating knob 219 is manually turned in one direction from a releasing position (refer to FIG. 3(*b*)) where all the anchoring plates 217 are located in the support shaft 213, the cam members 216*a*, 216*b* which are respectively screwed with the feed screw parts 214*a*, 214*b*, synchronize with each other and move closer to each other in accordance with the turning angle. The anchoring plates 217 abutting on the cam members 216*a*, 216*b* are pressed outward in a radial direction, and protrude from an outer diameter surface of the support shaft 213 through the openings 213*a* thereof, and abut on the inner surface of the cylindrical member 6. The cylindrical member 6 is thereby anchored to the inner circumferential side thereof (refer to FIG. 3(*a*), anchoring position).

Examples of the resin for the cylindrical member 6 include polypropylene, an acrylonitrile-butadiene-styrene copolymer, an acrylonitrile-ethylene propylene rubber-styrene-copolymer, polyamide, polycarbonate, polyacetal, polyethylene, polystyrene, polyarylate, polyphenylene oxide, polymethyl methacrylate, polyvinyl chloride, polysulfone, polyether sulfone, polyphenylene sulfide, polyarylate, polyamideimide, polyetherimide, polyether ether ketone, polyimide, fluororesin, polyethylene terephthalate, and polybutylene terephthalate. However, the resin for the cylindrical member 6 is not limited to these resins.

Figure 4A:
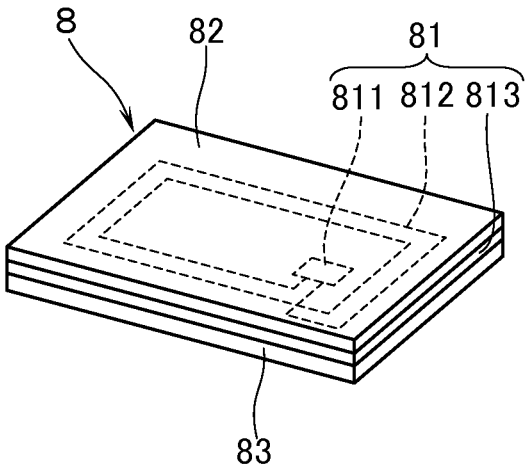
FIG. 4(*a*) is a plan view illustrating a structure of a data carrier member, and FIG. 4(*b*) is a cross sectional view thereof.
Figure 4B:
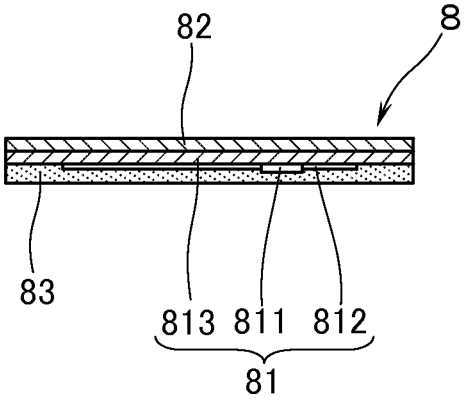

As the data carrier member disposed in the carrier disposition area DA, a label-shaped IC tag 8 which can store data is used. As illustrated in FIGS. 4(*a*), 4(*b*), the IC tag 8 can read, store, or transmit data using an electromagnetic wave as a communication medium. The IC tag 8 includes an IC inlet 81, a surface sheet 82, and a double-sided adhesive sheet 83. The IC inlet 81 is constituted by an IC chip 811 that acts at a predetermined resonance frequency (for example, 135 kHz, 13.56 MHz, 920 MHz, or 2.45 GHz); an antenna 812; and a circuit substrate 813 that holds the IC chip 811 and the antenna 812. The IC inlet 81 is stuck to the inner surface of the cylindrical member 6 through the double-sided adhesive sheet 83. Information related to the above-described data can be printed, and a bar code or a two-dimensional code can be also indicated on the surface of the surface sheet 82, opposite to the IC inlet 81.

As the circuit substrate 813 and the surface sheet 82, a sheet material such as a synthetic resin film, a paper material, or nonwoven fabric can be used. Examples of the synthetic resin film include films of polyethylene (PE), polypropylene (PIP), polyethylene terephthalate (PET), polycarbonate (PC), polyurethane (PU), polyvinyl chloride (PVC), and polyimide. Examples of the paper material include high-quality paper, coated paper, kraft paper, and glassine paper. The thickness of each of the circuit substrate 813 and the surface sheet 82 is not particularly limited, and can be appropriately set in accordance with purposes. For example, the thickness of each of the circuit substrate 813 and the surface sheet 82 is preferably 5 μm or more and 2000 μm or less, particularly preferably 10 μm or more and 500 μm or less. The double-sided adhesive sheet 83 can be formed, for example, with acrylic, silicone, rubber, polyester, and polyurethane adhesives. Above all, the acrylic adhesive is preferable because an adhesive force thereof is easily controlled. The thickness of the double-sided adhesive sheet 83 is not particularly limited, and can be appropriately set in accordance with purposes. For example, the thickness of the double-sided adhesive sheet 83 is preferably 1 μm or more and 300 μm or less, particularly preferably 5 μm or more and 150 μm or less. Furthermore, the double-sided adhesive sheet may include a core. The IC tag 8 may further include a magnetic body layer on a surface of the circuit substrate of the IC inlet 81 (the surface on the side of the surface sheet 82) and/or the surface opposite thereto (the surface on the side of the double-sided adhesive sheet 83) in order to reduce an influence of the metal on the IC tag 8. The thickness of the magnetic body layer is not particularly limited, and can be appropriately set in accordance with purposes. For example, the thickness of the magnetic body layer is preferably 20 μm or more and 3000 μm or less, particularly preferably 50 μm or more and 1000 μm or less.

The pressing means 3 includes a pressing roller 31 disposed at a position adjacent to the left end of the release plate 24. The pressing roller 31 rolls on the surface of the adherend AH conveyed by moving of the table 11, and sticks the adhesive sheet AS to the adherend AH while pressing the adhesive sheet AS thereto.

The conveying means 1, the delivering means 2, and the pressing means 3 are covered with the cover 5. As illustrated in FIG. 2, in a portion facing one end (the right side in FIG. 2) of the support shaft of the cover 5, an opening and closing door 51 which is openable and closable is disposed on the right side in FIG. 2 in order to fix the cylindrical member 6 around which the raw sheet RS is wound to the external surface of the delivering part 21 and recover the release sheet RL wound by the winding shaft 27. On the side of the delivering part 21 of the opening and closing door 51, there is disposed a reader-writer RW as a data communication means for performing data communication with the IC tag 8. The reader-writer RW includes an antenna for reader-writer RW1 and a reader-writer main body RW2. The antenna for reader-writer RW1 is connected to the reader-writer main body RW2 so as to be able to communicate with each other. The antenna for reader-writer RW1 performs communication (transmits and receives data) by a mutual induction action with the antenna 812 of the IC tag 8, reads data in the IC chip 811, and makes the IC chip 811 store predetermined data to manage data. The reader-writer main body RW2 is connected to a control means CM including a sequencer, PC, and the like so as to be able to communicate with each other. The reader-writer main body RW2 totally performs the following. That is, for example, the reader-writer main body RW2 makes the IC chip 811 store predetermined data, controls the whole sheet sticking device based on the predetermined data read from the IC chip 811, and displays the predetermined data on a display unit such as an operation panel or a monitor (not illustrated).

Next, a data management method will be described. First, a worker externally inserts the cylindrical member 6, around which the raw sheet RS is wound and to the inner surface of which the IC tag 8 is stuck, into the support shaft 213 for positioning. Thereafter, the worker manually turns the operating knob 219 in one direction, moves the anchoring plates 217 from the releasing position to the anchoring position, anchors the cylindrical member 6 from an inner circumferential side thereof, and closes the opening and closing door 51. The control means CM controls the reader writer RW before sticking starts, and makes a current flow in the antenna for reader-writer RW1. The control means CM thereby generates a transmitting means such as a magnetic flux, an electromagnetic field, or a microwave, generates an electromotive force through the antenna 812, and reads data such as a product name, a type, and a remaining length of the adhesive sheet AS stored in the IC tag 8, the remaining number of the adhesive sheets cut in half, a recommended delivery speed at which the adhesive sheet AS can be optimally delivered, a recommended sticking tension or a recommended pressing force, with which the adhesive sheet AS can be optimally stuck, and a recommended sticking condition of the adhesive sheet AS such as a quality assurance period.

Subsequently, the control means CM controls the entire sheet sticking device including a driving equipment such as the linear motion motor LM and the rotary drive motor DM3 based on the read data, and makes the sheet sticking device perform sticking. The control means CM can control the reader writer RW, generate the transmitting medium, and write the data on the IC tag 8 during the rotation of the cylindrical member 6 after delivering starts. Examples of the data written at this time include the number of the adhesive sheets AS used, a length of the raw sheet RS used, and date and time of use, and the like. When sticking processing by the adherend AH for the necessary planned number of the adhesive sheets AS is finished before all the adhesive sheets AS are used, the control means CM controls the reader writer RW, and makes the IC tag 8 store data such as the remaining length and the remaining number of the adhesive sheet AS for data management. The remaining length of the adhesive sheet AS stored is calculated with the number of rotation of the rotary drive motor DM3, a pulse thereof, or the like. The remaining number of the adhesive sheet AS is calculated by the number, or the like, as detected by a detecting means for detecting the adherend AH (not illustrated) or the like.

According to the embodiment, the protecting member 218 is attached to the distal end of the support shaft 213, and the operation shaft 214 is inserted into the protecting member 218 for protection. Therefore, a protrusion length of the operation shaft 214 can be made shorter by the length of the protecting member 218. Therefore, bending rigidity of the operation shaft 214 can be higher than that in the above-described known art, and bending of the operation shaft 214 by a load of the cylindrical member 6 can be suppressed. In addition, a flange part 218*c* is formed in the protecting member 218 and an inner circumferential surface of such a portion of the cylindrical member 6 as is positioned in front of the proximal end of the flange part 218*c* constitutes the carrier disposition area DA. Therefore, a gap in the diametrical direction is generated between the protecting member 218 and the cylindrical member 6. When the label-shaped IC tag 8 is disposed in the carrier disposition area DA, there will not occur such a problem that the IC tag 8 may be broken due to contact with the operation shaft 214 when the cylindrical member 6 is fitted to an external surface of the support shaft 213.

Hitherto, the embodiment of the present invention has been described with reference to the drawings. However, the present invention is not limited thereto. The embodiment has exemplified the protecting member 218 made of a resin and disposed at the distal end of the support shaft 213. However, any material which can protect the operation shaft 214 may be used for the protecting member 218. The material may be paper, metal or wood. The protecting member 218 may be integrally formed with the support shaft 213. In the embodiment, the protecting member 218 having a stepped shape made of the base part 218*a* and the reduced-diameter section 218*b* has been exemplified, but is not limited thereto. For example, the protecting member 218 may have an outer circumferential surface having a shape that is tapered forward.

The embodiment has exemplified the operating means which operates projection and retraction of the anchoring plates 217, 217 for anchoring the cylindrical member 6, and includes the operation shaft 214 and the cam members 216*a*, 216*b*. However, the operating means is not limited thereto. The present invention can be applied, for example, to an operating means in which an anchoring plate is driven by supplying compressed air, the support shaft 213 concentrically includes a pipe for supplying the compressed air as a shaft part, and in which the distal end thereof protrudes forward. In addition, the anchoring plates 217 disposed at 90° intervals in a circumferential direction on the same circumference have been exemplified. However, the anchoring plates 217 are not limited thereto. The anchoring plates 217 may be disposed at 120° intervals or 180° intervals in the circumferential direction on the same circumference. Furthermore, the screw parts 214*a*, 214*b* having opposite screwing directions to each other have been exemplified. However, the screw parts 214*a*, 214*b* may have the same screwing direction as each other if projection and retraction of the anchoring plates 217 can be operated.

In addition, the embodiment has exemplified the data carrier member using the label-shaped IC tag 8 which can be stuck (or adhered). However, for example, the data carrier member may be a bar code or a two-dimensional code which can only store data, a magnetic body which can transmit on and off data only by magnetizing and demagnetizing, or a magnetic sheet which can read and store data by a magnetic pattern or transmit data. When the data carrier member is the bar code or the two-dimensional code, the data communication means includes a CCD camera, a bar code reader, or the like in accordance with the type of the data carrier member. When the data carrier member is the magnetic body or the magnetic sheet, the communication means may include a so-called magnetic head. The magnetic head generates a magnetic field and magnetizes the magnetic body to write data, or detects a change in a magnetic field to read data. The data communication means may be disposed at a predetermined position on an inner surface of the opening and closing door 51. When additional data cannot be written, as in the bar code or the two-dimensional code, a code accessible to a host control means such as a host computer may be stored in these codes, and such data as described above may be received from the host control means.

The embodiment has exemplified the reader-writer RW disposed on the opening and closing door 51 of the cover 5. However, the disposing position and the disposing method thereof are not limited thereto if the reader-writer RW can perform data communication with the IC tag 8 disposed on the inner circumferential surface of the cylindrical member 6. For example, the reader-writer RW may be conveyed using a conveyance robot to a position close to the IC tag 8 if necessary. A handy type or hand-held type reader-writer RW may be used to manually communicate with the IC tag 8.

In addition, as the driving equipment in the above-described embodiment, there may be employed an electric equipment such as a rotary drive motor, a linear motion motor, a linear motor, a uniaxial robot, or an articulated robot, and an actuator such as an air cylinder, a hydraulic cylinder, a rod-less cylinder, or a rotary cylinder, or the like. In addition, the driving equipment may also use a direct or indirect combination thereof.

The adherend AH may be a cardboard case, a resin container, a semiconductor wafer, an optical disc, or a plate member such as a glass plate, a steel plate, or a resin plate. The adherend AH may be also a member or a material in any form, and is not limited. An object to be stuck or adhered to the adherend AH may be a label, a protecting sheet, a dicing tape, a die attach film, any other sheet, a film, a tape, or the like. The object to be stuck to the adherend AH may be an adhesive sheet in any form for any purposes, and is not limited. For example, in order to perform various processing to a semiconductor wafer by sticking an object to the semiconductor wafer, the support device and the data management method of the present invention can be applied. That is, in order to stick a protecting tape for protecting a circuit surface of the semiconductor wafer when a back surface of the semiconductor wafer is ground, or a mount tape for sticking a ring frame on an outer circumference of the semiconductor wafer, the support device and the data management method of the present invention can be applied.

The elongated body is not limited to the raw sheet RS, and may be a belt-shaped adhesive sheet, paper, cloth, copper plate, belt, resin, wood plate, or the like, and may be an elongated thread, string, wire, code, tube, hose, chain, or the like.

In addition, the embodiment has exemplified the support device for supporting the cylindrical member 6 around which the raw sheet RS is wound such that the raw sheet RS can be delivered. However, the support device may support the cylindrical member 6 such that various elongated bodies can be wound around the cylindrical member 6. For example, the support device may make the winding shaft 27 in the embodiment support the cylindrical member 6 to wind the release sheet RL.

REFERENCE SIGNS LIST

RS: raw sheet (elongated body), RW: reader-writer (data communication unit), DM: carrier disposition area, 21: delivering part (support device), 213: support shaft (constituting element of support device), 214: operation shaft (shaft part as constituent element of operating means), 217: anchoring plate (anchoring means), 218: protecting member, 218*b*: reduced-diameter section, 219: operating knob (constituent element of operating means), 4: frame (support body), 6: cylindrical member, 8: IC tag (data carrier member), and 812: antenna.

The invention claimed is:

1. A support device for supporting a cylindrical member around which is wound an elongated body, the support device comprising:

a support shaft, supported by a support body in a cantilevered state, for supporting the cylindrical member that is fitted to an external surface of the support shaft from an opening on one end in a longitudinal direction of the cylindrical member;

an anchoring means, built into the support shaft, for anchoring the cylindrical member from an inner circumferential side of the cylindrical member;

an operating means comprising a shaft part smaller in diameter than the support shaft, the shaft part protruding forward from a distal end of the support shaft where a side on which the support shaft is supported in the cantilevered state is defined as a proximal end and where an opposite side thereto is defined as the distal end, the shaft part being arranged to switch between anchoring of the cylindrical member by the anchoring means and releasing thereof;

a protecting member which is attached to the distal end of the support shaft and through which is inserted the shaft part, the protecting member further comprising a reduced-diameter section smaller in diameter than the support shaft; and a data carrier member formed at a part of the cylindrical member which is located further forward from a proximal end of the reduced-diameter section on an inner peripheral surface of the cylindrical member.

2. A data management method for managing data relating to an elongated body wound around a cylindrical member by using the support device according to claim 1, the method comprising:

fitting the cylindrical member to an external surface of the support shaft from the opening on one end in the longitudinal direction of the cylindrical member; and performing data communication between a data communication means and a data carrier member which is disposed in a carrier disposition area, where an inner circumferential surface of such a portion of the cylindrical member as is positioned in front of the proximal end of the reduced-diameter section is defined as the carrier disposition area.

* * * * *